US006305201B1

(12) United States Patent
Ghiran et al.

(10) Patent No.: US 6,305,201 B1
(45) Date of Patent: Oct. 23, 2001

(54) METHOD AND APPARATUS FOR FORMING UNOBSTRUCTED HOLES IN HOLLOW HYDROFORMED METAL PARTS

(75) Inventors: Mircea Ghiran, Lake Orion; Paul C Oberski, Roseville, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/828,689

(22) Filed: Apr. 9, 2001

(51) Int. Cl.[7] ..... B21D 26/02; B21D 28/18
(52) U.S. Cl. ..... 72/55; 72/58; 83/53; 83/54
(58) Field of Search ..... 72/55, 58; 83/53, 83/54

(56) References Cited

U.S. PATENT DOCUMENTS

| | | | | |
|---|---|---|---|---|
| 5,398,533 | | 3/1995 | Shimanovski et al. | 72/55 |
| 5,666,840 | | 9/1997 | Shah et al. | 72/55 |
| 5,765,420 | * | 6/1998 | Schaefer | 72/55 |
| 5,974,846 | * | 11/1999 | Ash | 72/55 |
| 5,996,455 | * | 12/1999 | Haag et al. | 72/55 |

* cited by examiner

*Primary Examiner*—David Jones

(74) *Attorney, Agent, or Firm*—Charles E. Leahy

(57) ABSTRACT

Method and apparatus for forming unobstructed holes in a hydroformed metal part employs a punch having a peripheral side conforming to the desired hole shape and an end face having a central cutting edge with a high point that contacts on closure of a hydroforming die with an unsupported wall section of the part initiating a stress riser therein. During forming of the part, the hydraulic pressure forces the above wall section outward against this high point increasing the magnitude of the stress riser. The punch is advanced while maintaining the hydraulic pressure causing the above high point to fracture this wall section at the stress riser and the above cutting edge to then split and cut this wall section to form oppositely facing cut edges in this section. Simultaneously, oppositely angled cutting edges at opposite ends of the central cutting edge and at the punch end face periphery then cut this wall section in directions away from the oppositely facing cut edges to form oppositely extending slugs. As the punch continues to be advanced, contoured portions of the punch end face with the aid of the hydraulic pressure contact the slugs to provide a seal to maintain the hydraulic pressure while bending the slugs as they are being cut into the interior of the part. The peripheral side of the punch with further punch movement engages the slugs with an interference fit to maintain the hydraulic pressure and forces the slugs into positions forming an unobstructed hole in the part while remaining integral therewith.

8 Claims, 7 Drawing Sheets

METHOD AND APPARATUS FOR FORMING UNOBSTRUCTED HOLES IN HOLLOW HYDROFORMED METAL PARTS

This invention relates to method and apparatus for forming unobstructed holes in hollow hydroformed metal parts and more particularly to forming an unobstructed hole in hollow hydroformed metal parts with a punch while leaving multiple slugs produced by cutting action of the punch integral with and internal of the part.

BACKGROUND OF THE INVENTION

It is well known in the art of hydroforming hollow metal parts to use the hydroforming pressure to assist a punch in piercing one or more holes in the hydroformed part while the part remains in the hydroforming die. The hydroformed part can take various shapes as for example a chassis frame and engine cradle for a motor vehicle wherein one or more holes are required in these hydroformed parts for the attachment of one or more other frame or cradle forming parts respectively. This piercing operation with a punch can produce a detached slug left in the hydroformed part that may or may not be undesirable. In the latter case and depending on whether a single hole is punched or aligned holes in opposite sides of a hydroformed part are punched, the detached slugs in either situation can be removed as disclosed in U.S. Pat. No. 5,398,533 issued Mar. 21, 1995 and U.S. Pat. No. 5,666,840 issued Sep. 16, 1997 which are both assigned to the assignee of this invention.

Is also well known in the case of where a loose slug left in the hydroformed part is undesirable, that the piercing can be accomplished with a punch that produces a slug that remains integral with the hydroformed part. This is shown and labeled as "Prior Art" in FIG. 1 of the accompanying drawings. In this case, as in other hydroforming operations, a hollow metal part 10 has initially been forced by hydraulic fluid 11 at high pressure to conform to the surface of a die cavity 12 in a hydroforming die 14 comprising mating die halves 16 and 18. A punch 20 mounted for reciprocal movement in a cylindrical bore 22 in the upper die half 16 has, as distinguished from the above cited U.S. Patents, a chamfered or beveled portion 24 of limited peripheral extent that interrupts the sharp peripherally extending cutting edge 26 at the end face 28 of the punch. The chamfered portion 24 extends through a small arc about the periphery of the punch face, for example 45 degrees, and as a result, when the punch is advanced into the part while the internal hydraulic pressure is maintained and cutting of the part takes place with the remaining cutting edge 26, a small portion 30 of the slug 32 that is produced remains intact or integral with the hydroformed part and is forced with the slug by the punch face into the interior of the hydroformed part.

In the above cited U.S. Patents and FIG. 1, the punches illustrated produce circular holes in the hydroformed part. However, it is also well known by those skilled in this art that these punches as well as punches in general can be made to produce various hole shapes such as square, rectangular, triangular or other common geometrical shapes or an irregular shape as required for a particular hydroformed part. In either event and as particularly concerns the piercing of hydroformed parts, there are limitations on the size of the hole that can be punched and particularly where the slug is left attached to the side of the hole as in the case of the Prior Art in FIG. 1. For example and again referring to FIG. 1, where any internal cross sectional dimension A of the hydroformed part 10 is less than dimension B of the slug 32 that lies in the same plane with the former dimension and in this case is the diameter of the punch, the slug can hit the opposite interior side of the part as the slug is punched as shown in FIG. 1. This can produce several undesirable results such as is the case with the slug 32 obstructing the hole as shown and thereby shortening the depth of the hole which could be unacceptable for the reception of a mating part (not shown). The worst condition has been found to be a miss-shaped hole with a very distorted side and results from the slug hitting the interior of the part and then being further bent by the punch as shown by the deformed portion 30A of the slug illustrated with phantom lines.

SUMMARY OF THE INVENTION

The present invention in method and apparatus for forming unobstructed holes with constant cross sectional dimensions in hollow hydroformed metal parts without leaving a loose slug in the part solves such problems by forming multiple slugs of significantly less size than that where a single slug would be punched to form the same size hole and leaving them attached to (integral with) the side of the hole in a manner internal of the part so as to not obstruct the hole from within the part or with their formation and bending cause distortion of the shape of the hole. Moreover, this is accomplished while the hydroforming pressure is maintained in the part while still in the hydroforming die and utilized without incurring any significant leakage of the hydraulic fluid in the multiple slug forming and bending operations of the present invention.

In the present invention, this is accomplished with a single punch that can be readily adapted within the teachings of this invention to produce holes of various sizes and shape by forming the configuration of the punch end face and the cutting edge configuration on the punch end face according to the number, size and shape of the multiple slugs desired for the particular size and shape of hole desired while still maintaining all the slugs integral with the part and not allowing them to obstruct or cause distortion of the hole. Moreover, the multiple slugs are bent into the interior of the part in a certain manner by the punch so as to not only not obstruct the hole, but also to add considerable surrounding side area to the hole resulting in a substantially improved mating joint for the part to be attached in the hole.

In the method and apparatus of the present invention, the punch employed has a cylindrical peripheral side conforming to the desired hole shape and an end face having an outwardly projecting, centrally located, angled cutting edge with ends terminating at the peripheral side of the punch. This central cutting edge has a high point that prior to hydroforming the part contacts with an unsupported section of the part opposite the punch end face to initiate a stress riser in this section on closing the die about the part. Then during hydroforming of the part in the die, the internal hydraulic pressure forming the part also stretches and bends the unsupported wall section outward about the above high point significantly increasing the magnitude of the stress riser.

Following hydroforming of the part, the punch is advanced while maintaining the hydraulic pressure in the part causing the high point on the central cutting edge to fracture the stretched wall section at the stress riser and this cutting edge to then split and cut or shear the stretched wall section in directions toward the peripheral side of the punch to form oppositely facing sheared edges in the stretched wall section. Simultaneously, oppositely angled cutting edges at opposite ends of the central cutting edge which terminate at the peripheral side of the punch then shear or cut the stretched and bent wall section in directions away from the oppositely facing cut edges with the aid of the hydraulic pressure to form oppositely extending slugs that remain integral with the part. As the punch continues to be advanced, smoothly contoured portions of the punch end face with further aid of the hydraulic pressure bend the slugs as they are being cut into the interior of the part and eventually the peripheral side of the punch with further punch movement engages the slugs with an interference fit and forces them into positions in the part while maintaining the integrity of the internal hydraulic pressure so as to form an unobstructed hole in the part. There are at least two such slugs that are formed in this manner to form a hole and more such slugs can be formed in a similar manner to suit a certain size and shape hole as disclosed in more detail latter. Furthermore, two or more such slugs can thus be formed and bent to form the same size and shape hole and the slugs need not and preferably do not remain attached to a straight or curved side portion of the hole as disclosed in more detail later.

Moreover, the slugs can be of different size and shape depending on the size and shape of the hole desired and also to prevent the plugs from obstructing the hole or contacting the interior of the part. For example, there can be two or more slugs thus formed but of unequal size so as to prevent their hitting the interior of a hydroformed part where the interior surface of the part is not a uniform distance from where the punch enters the part as disclosed in more detail later. The method and apparatus design principles taught here can be applied to holes of various shapes as indicated above and especially to those with straight sides such as square, rectangular, triangular shaped holes, etc. In addition, the punch can be oriented so as to form an unobstructed angled hole in the part where it is desired to attach a part in the hole at a predetermined angle to the hydroformed part. Furthermore, it is contemplated as indicated above, that where the desired hole is defined by one or more curved sides as well as straight sides, separate slugs may or may not be sheared and left attached to such curved sides in practicing the present invention.

And thus in accordance with the present invention, larger unobstructed holes without leaving a loose slug can be punched in the same size and shape hydroformed part then with presently known methods and apparatus. Moreover, the holes produced by the present invention in a hydroformed part have, regardless of the shape of the hole, substantially greater surrounding wall integrity resulting in a substantially enhanced or stronger joint for attachment of another part as compared with holes produced in conventional manner by punching a single slug that is either blanked out or remains attached. Furthermore, the simplicity in using only a single punch in a single punching operation to form an unobstructed hole results in a low cost solution to the problem of avoiding loose slugs, and/or miss-shaped or distorted holes with the added benefit of also improving the wall integrity of the hole.

It is therefore an object of the present invention to provide a new, improved, simple, low cost method and apparatus for forming unobstructed holes without loose slugs in hollow hydroformed metal parts while the parts remain in their hydroforming die.

Another object of the present invention is to provide a new and improved method and apparatus that is readably adaptable to forming unobstructed holes of various shapes and sizes in hollow hydroformed metal parts while remaining in their hydroforming die by cutting and bending but not detaching multiple slugs from the parts.

Another object of the present invention is to provide a new and improved method and apparatus for cutting holes in hollow hydroformed metal parts while they remain in their hydroforming die under internal hydraulic pressure wherein a hole is formed by cutting multiple slugs while leaving them attached to the side of the hole and bending them into the interior of the part in a manner so as to not obstruct the hole they form.

Another object of the present invention is to provide a new and improved method and apparatus that is readably adaptable to forming unobstructed holes of various shapes and sizes in hollow hydroformed metal parts while the parts remain in their hydroforming die under internal hydraulic pressure by cutting but not detaching multiple slugs from the part and bending the slugs into the interior of the part as extensions of the side of the hole and in a manner so as to not obstruct the hole they form.

Another object of the present invention is to provide a new and improved method and apparatus for cutting holes in hollow hydroformed metal parts while the parts remain in their hydroforming die under internal hydraulic pressure wherein a hole is formed with a single punch and aid of the hydraulic pressure in a manner that cuts multiple slugs of a certain size and shape left integral with the part and bends them into the interior of the part so as to not obstruct the hole they form and wherein the slugs are sized differently so as to prevent their hitting the interior of the part.

Another object of the present invention is to provide a new and improved method and apparatus for cutting holes of a prescribed shape in hollow hydroformed metal parts wherein a hole is formed while the parts remain in their hydroforming die under internal hydraulic pressure by cutting multiple slugs of a certain shape and leaving them attached to the side of the hole and bending the slugs into the interior of the part in such a manner so as to not obstruct the hole and wherein the slugs are sized so as prevent their hitting the interior of the part and obstructing the hole along its depth.

Another object of the present invention is to provide a new and improved method and apparatus for piercing holes of a prescribed shape in hollow hydroformed metal parts while the parts remain in their hydroforming die under internal hydraulic pressure and without incurring any significant leakage of the hydraulic fluid wherein a hole is formed by a singular punch having an end face with a cutting edge configuration having a high point that fractures an unsupported wall section of the part with the aid of the hydraulic pressure with the cutting edge configuration then cutting multiple slugs of a certain size and shape in the unsupported wall section with further aid of the hydraulic pressure while leaving the slugs integral with the part and wherein the punch end face further has a smooth contoured configuration that bends the slugs as they are cut with further aid of the hydraulic pressure and the punch end face further having a peripheral side that completes the bending of the slugs into positions within the part so as to not obstruct the hole while contributing to the size of the side of the hole.

Another object of the present invention is to provide a new and improved method and apparatus for piercing holes of a prescribed shape in hollow hydroformed metal parts while the parts remain in their hydroforming die and without incurring any significant leakage of the hydraulic fluid wherein a hole is formed by a punch having a cutting end face that first fractures and then cuts multiple slugs of a certain size and shape in an unsupported wall section of the part and leaves the slugs integral with the side of the hole with the punch end face further having a smooth contoured configuration that with the aid of the internal hydraulic pressure bends the slugs as they are cut into the interior of the part and the punch end face further having a peripheral side that completes the bending of the slugs with an interference fit into positions within the part that add to the size of the side of the hole and wherein the slugs are sized so as prevent their hitting the interior of the part and being forced by such contact into positions obstructing the hole.

Another object of the present invention is to provide a new and improved method and apparatus for piercing holes of a prescribed shape in hollow hydroformed metal parts while the parts remain in their die under internal hydraulic pressure and without incurring any significant leakage of the hydraulic fluid wherein a hole is formed by a punch having an end face that cuts multiple slugs of various sizes and shapes and leaves them integral with the side of the hole with the punch end face further having a smooth contoured configuration that bends the slugs as they are cut with the aid of the hydraulic pressure and the punch further having a peripheral side that with an interference fit completes the bending of the slugs into positions within the part that do not obstruct the hole and instead add to the size of the side of the hole and thus to the integrity of the joint it forms for receiving another part.

These and other objects, advantages and features of the present invention will become more apparent to those skilled in the art from the following detailed description and accompanying drawings wherein:

DETAILED DESCRIPTION OF THE DRAWINGS

Figure 1:
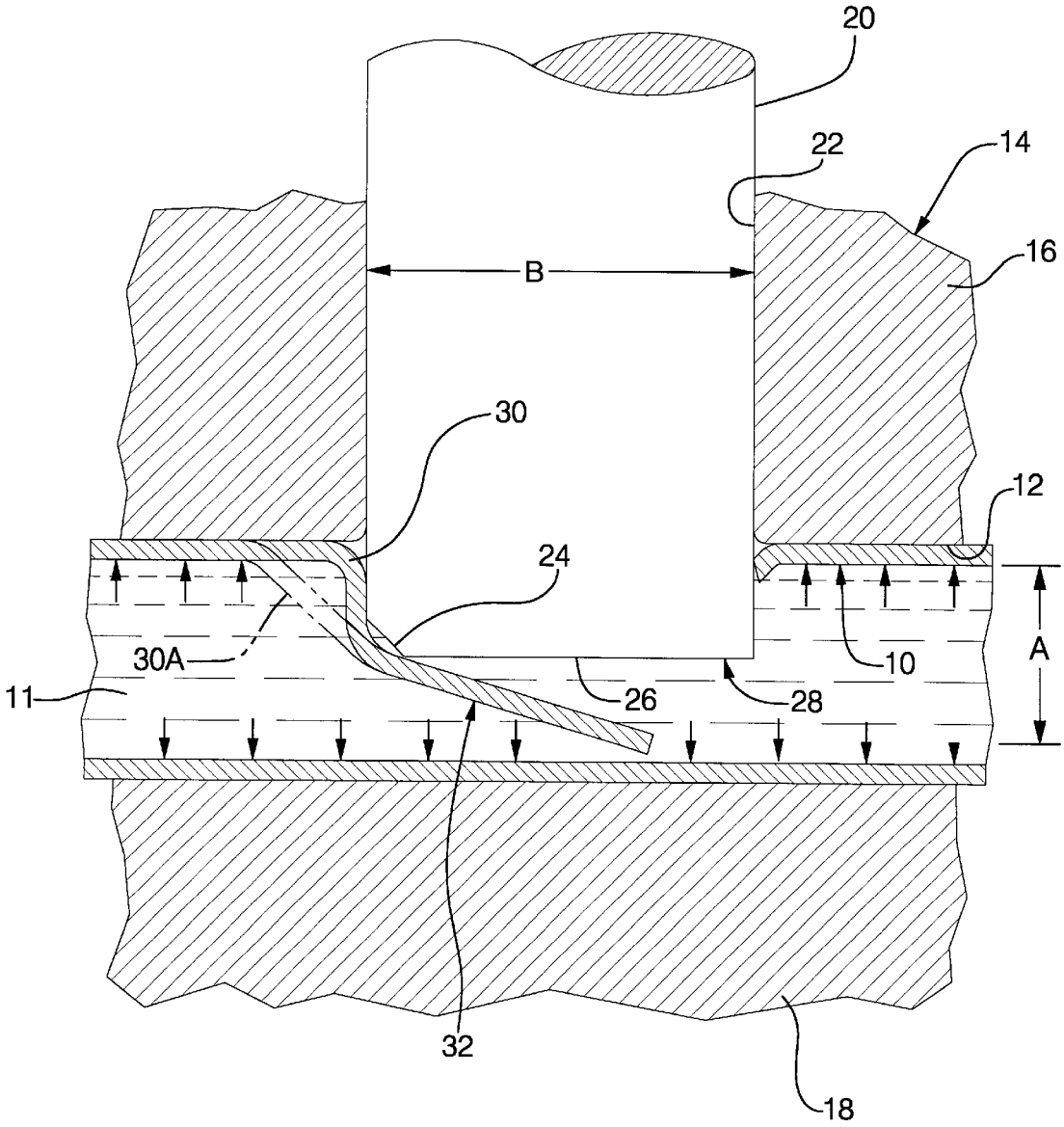
PRIOR ART FIG. 1
FIG. 1 is a partial view partially in section of prior apparatus shown forming a hole in a hydroformed metal part while the latter remains in its hydroforming die and whose relevant details are described above.
Figure 2:
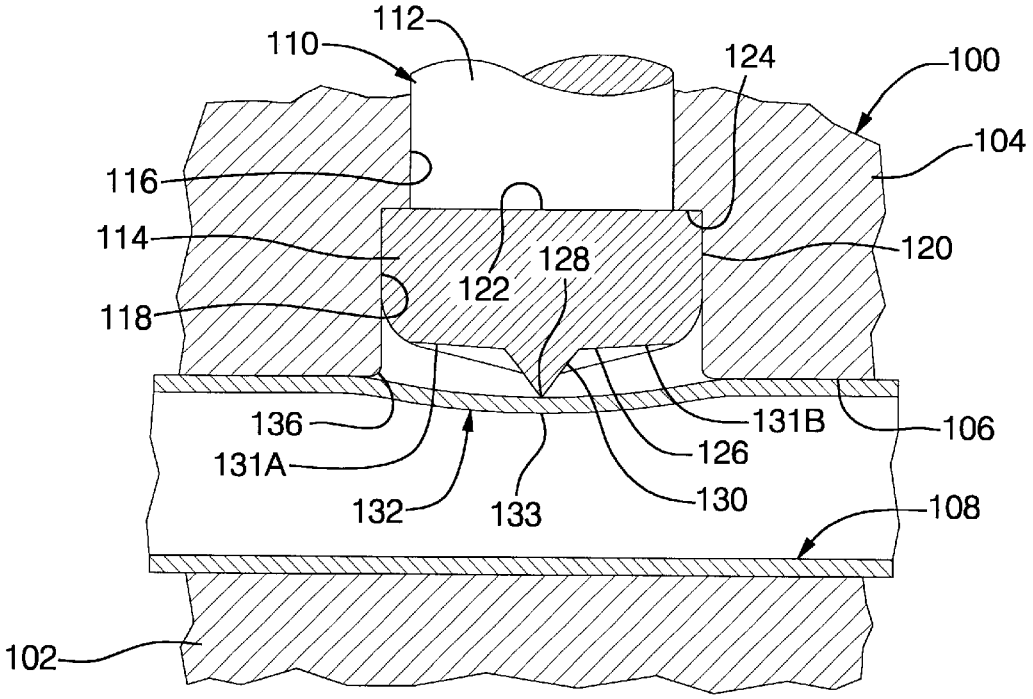
FIG. 2 is a partial view partially in section of a preferred embodiment of the present invention where the hole forming punch is shown in its initial position and prior to introduction of hydraulic fluid under pressure to form the part.

Referring to FIG. 2, there is shown a hydroforming die 100 comprising a lower die half 102 and an upper die half 104 which mate to form a die cavity 106 of prescribed shape. A hollow sheet metal part 108 is captured within the die cavity and hydraulic fluid is eventually delivered to the interior of the part where it is raised to a high pressure (e.g. water at 10,000 psi) to form the part to the die cavity surface by a suitable hydraulic system (not shown) in a conventional manner. The part illustrated is a motor vehicle frame member being made from a tubular steel section but it will be understood the part could be some other part suitable to hydroforming and the metal some other resilient metal such as aluminum, brass and copper and alloys thereof and suitable to hydroforming. Furthermore, it will be understood that the apparatus and method of forming the part as thus far described is conventional and well known by those skilled in the art.

In accordance with the present invention and to form a square shaped hole desired in the hydroformed part by piercing and bending two integral rectangularly shaped slugs of equal size and shape, there is provided in a preferred and illustrative embodiment of the invention a punch 110 having a stem portion 112 at its upper end and a head portion 114 of generally larger cross section at its lower end mounted for reciprocal movement in adjoining concentric bores 116 and 118 respectively in the upper die half 104. The punch stem 112 and bore 116 have close fitting circular cylindrical surfaces and a peripheral side 120 of punch head 114 and bore 118 have close fitting square shaped cylindrical surfaces. And with the bores 116 and 118 oriented at right angles to the die cavity 106 where the latter bore intersects the die cavity surface. The fully retracted or initial position of the punch 110 is shown in FIG. 2 and is determined by an annular shoulder 122 on the upper side of the punch head 114 abutting with a step 124 joining the bores 116 and 118. However, it will also be understood that instead of the punch stem 112, bore 116 and step 124 above described, the surface of the stem could be contiguous with the peripheral side 120 of the punch with then only a single bore 118 provided in the upper die half in which the punch is mounted. And with the punch's initial or fully retracted position determined by other means such as a retraction stop in its operating mechanism external of the upper die half.

The punch head 114 has an end face 126 that faces into the die cavity and is advanced from and retracted to this initial position by suitable conventional means such as a selectively operable hydraulic cylinder (not shown). In the fully retracted position of the punch shown in FIG. 2 and in what will be referred to as Stage 0 of the hole forming operation, a sharp high point 128 of a centrally located central cutting edge 130 on the punch end face 126 extends a predetermined small distance past the die cavity surface at the outer edge of bore 118 into the die cavity 106 (for example, 0.080–0.200 inches). The punch end face 126 has relieved portions 131A and 131B on opposite sides of the central cutting edge 130 thereby resulting in an unsupported wall section 132 of the part 108 opposite the punch end face 126. The unsupported wall section 132 of the part contacts with the sharp high point 128 of the punch causing this wall section to be bent slightly inward of the part about this point as the die halves 102 and 1042 are closed about the part thereby initiating a relatively small stress riser in this wall section at a location 133 directly opposite this sharp high point. This ensures that when hydraulic pressure is initially developed in the part following the completion of Stage 0, this pressure will immediately start bending this wall section outward of the part about the high point 128 on the punch end face as described in more detail later without first having to possibly stretch the part outward into contact with this high point to initiate the stress riser as for example would be case if the high point was initially located some distance away and as a result would require more stretching and thus thinning of the unsupported wall section than need be. Moreover, this initial position of the high point of the punch past the die cavity surface into the die cavity ensures that the stress riser will be initiated in this stage of the hole forming operation as the high point wears with usage.

Figure 3:
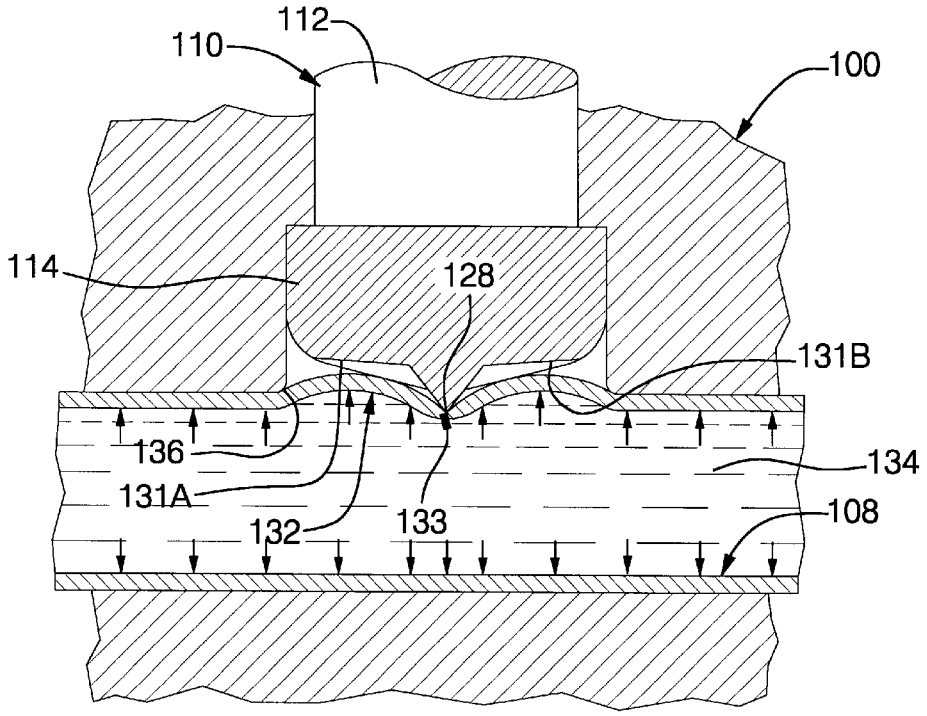
FIG. 3 is a view similar to FIG. 2 but showing the action of hydraulic forces on the apart and in particular the section of the part in which the hole is to be formed.

Referring to FIG. 3, following Stage 0 and in what will be referred to as Stage 1 of the hole forming operation, a suitable hydraulic fluid 134 is introduced to the interior of part 108 in a conventional manner and the pressure of the hydraulic fluid is raised while the punch remains in its fully retracted position. The part 108 is forced outward by the hydraulic pressure to conform to the die cavity surface in a conventional hydroforming manner and moreover, the unsupported wall section132 of the part opposite the punch end face is forced by the hydraulic pressure to stretch and bend outward of the part between the sharp high point 128 of the central cutting edge 130 on the punch end face 126 and a slightly chamfered or beveled peripheral edge 136 of the bore 118 where it intersects the die cavity surface in the upper die half. In Stage 1, this stretching and bending of the unsupported wall section 132 about the sharp high point 128 of the punch end face greatly increases the magnitude of the stress riser at the wall section location 133 initially established in Stage 0 prior to the admission of hydraulic fluid.

Figure 4:
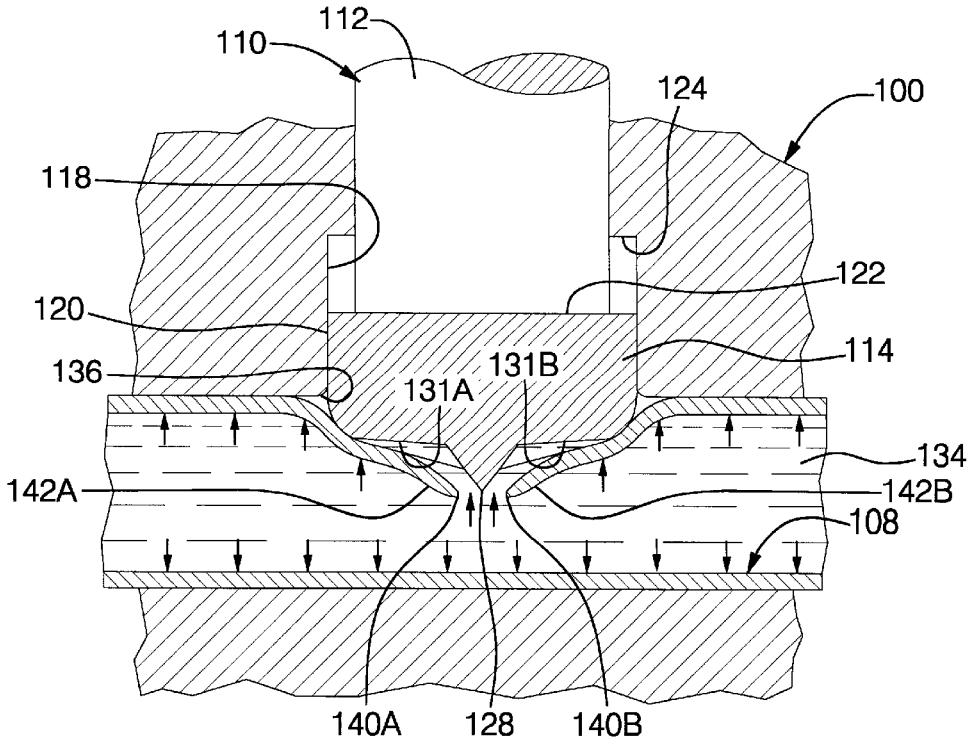
FIG. 4 is a view similar to FIG. 3 but showing initial advancement of the punch.

Following Stage 1 and while the hydraulic pressure is maintained in the part 108, the punch 110 is advanced in what will be referred to as Stage 2 of the hole forming operation as shown in FIG. 4. This inward punch movement coupled with the hydraulic pressure acting outward on the stretched and bent wall section 132 causes the latter to fracture at the high stress location 133 and then start splitting by cutting action of the central cutting edge 130 resulting in oppositely facing split edges 140A and 140B in the wall section 132 and the beginning of the formation of integral 142A and 142B, respectively, of ultimately rectangular shape (see FIG. 6). As the fracture occurs, the hydraulic fluid begins to escape from the confines of the hydroformed part toward the punch end face 126 as the slugs are formed by the central cutting edge 130 and by peripheral side cutting edges 146A,146B and 148A,148B at the periphery of the punch end face (see FIG. 7). This hydraulic action has a tendency to separate the slugs 142A and 142B being formed in the wall section 132 from the punch end face 126 and lead to leakage to the bore 118 in the upper die half. This is prevented by smoothly contoured portions 144A and 144B provided on the punch end face at opposite sides of the central cutting edge 130 that remain in contact with the outer surface of the slugs 142A and 142B, respectively, as they are being cut and bent with continuing advancement of the punch. The high pressure of the hydraulic fluid maintains a force on the slugs as they are bent inward and this force coupled with the spring back tendency of their metal creates an effective mechanical fluid seal to prevent the fluid from leaking past the punch end face as the punch advances.

Figure 5:
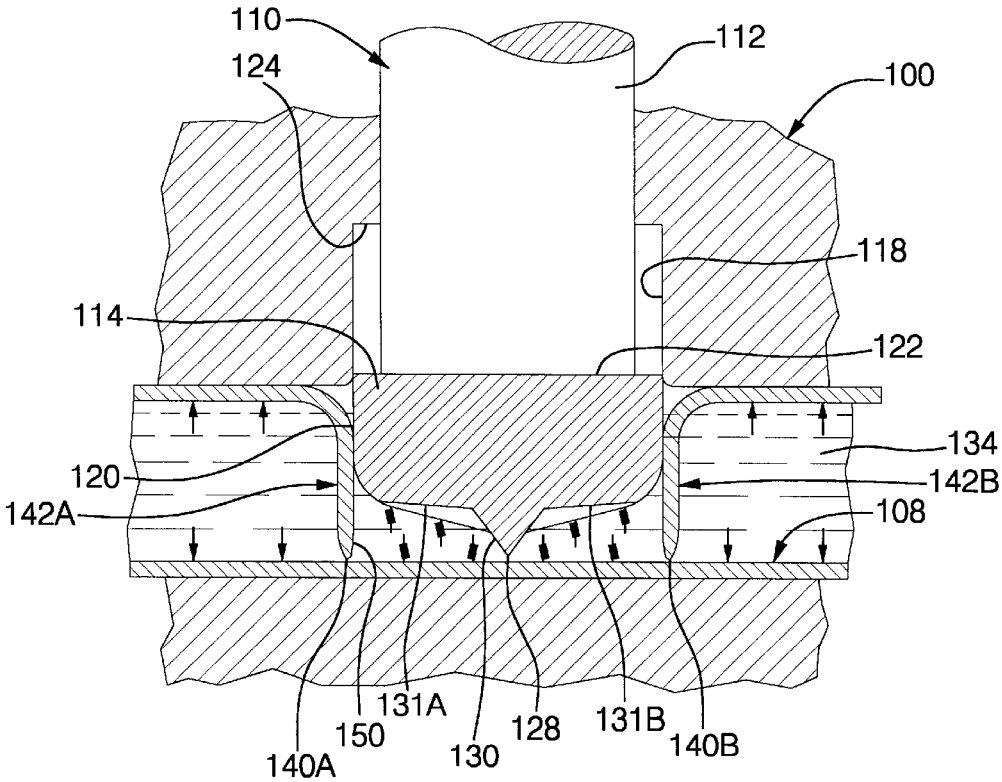
FIG. 5 is a view similar to FIG. 4 but showing final advancement of the punch.
Figure 6:
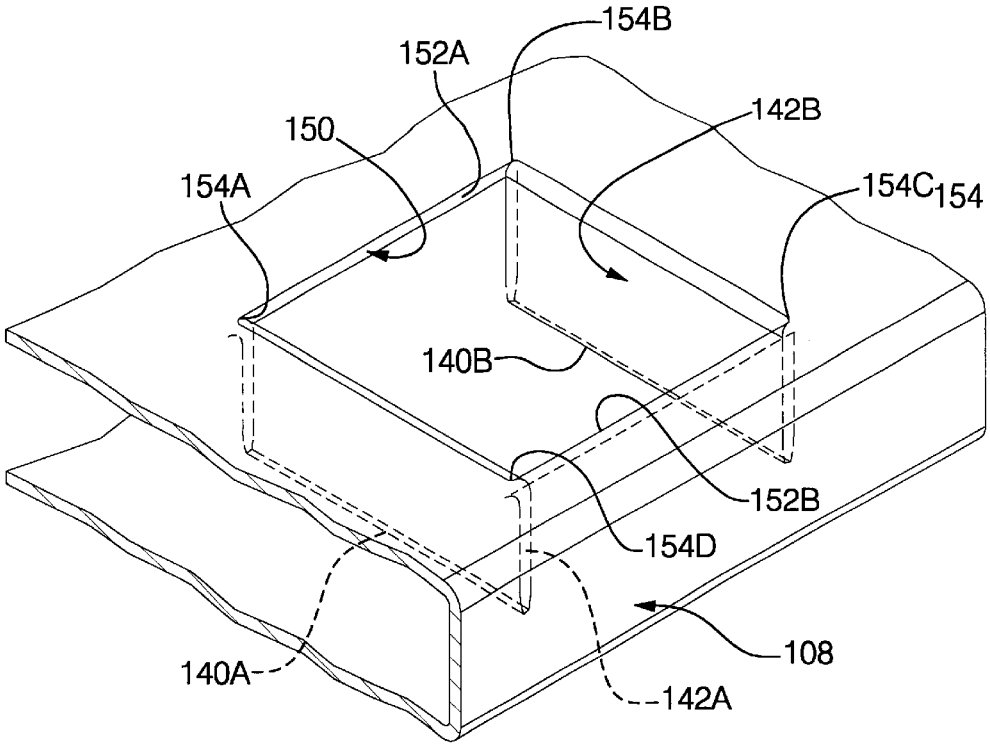
FIG. 6 is an enlarged partial three-dimensional view of the hydroformed part in FIG. 5 as removed from the die.
Figure 7:
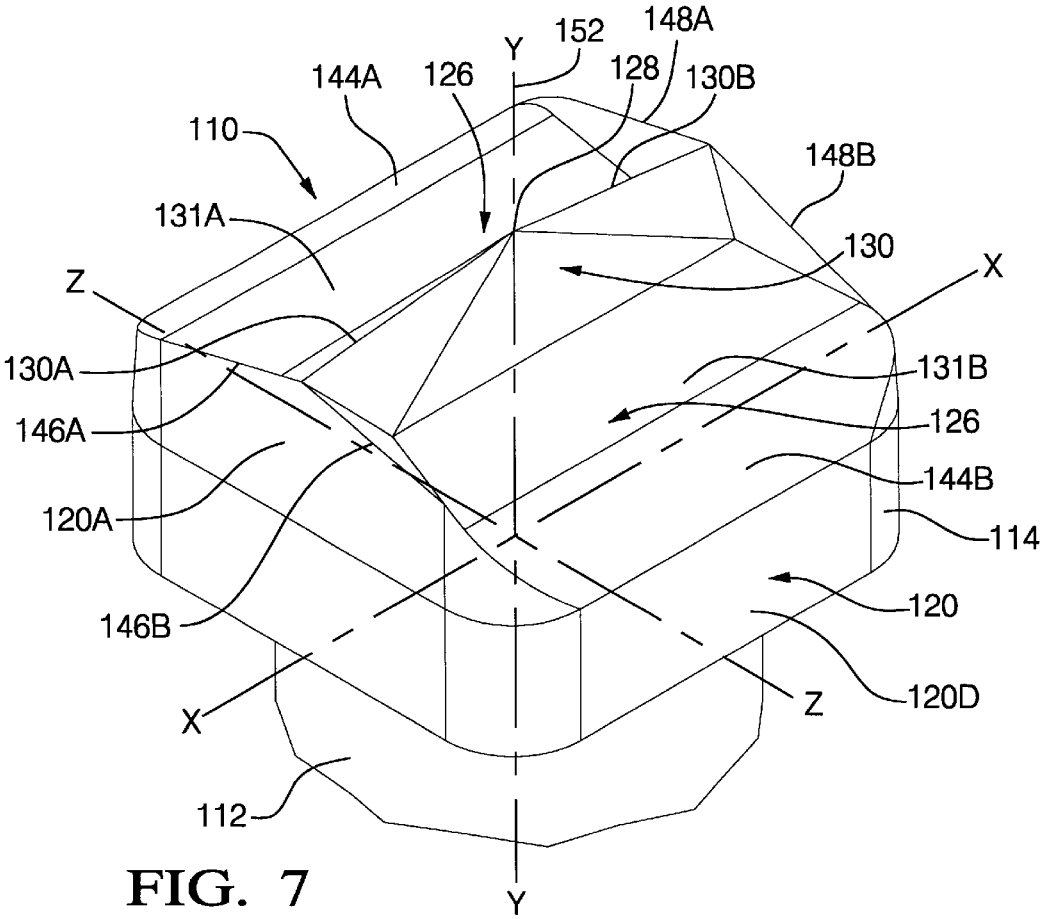
FIG. 7 is an enlarged partial three-dimensional view of the punch in FIG. 2.
Figure 8:
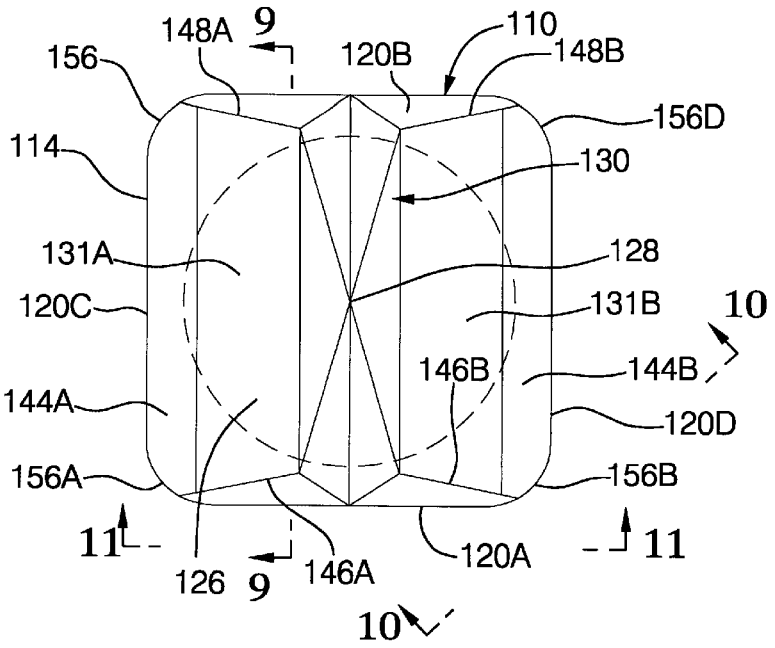
FIG. 8 is a top view of the punch in FIG. 7.
Figure 9:
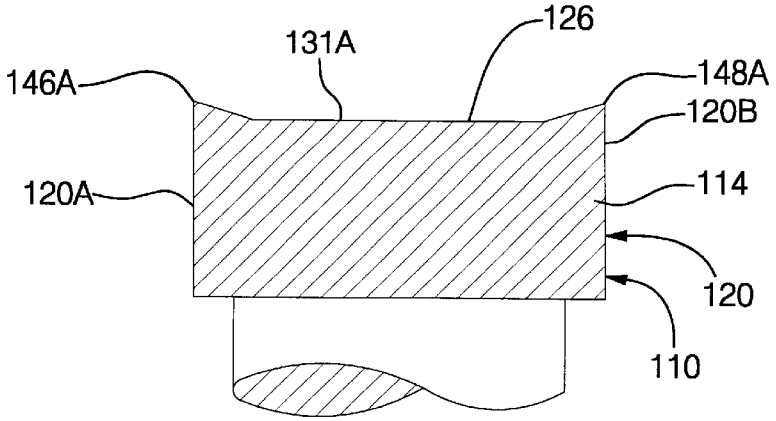
FIG. 9 is a view taken along the line 9—9 in FIG. 8 as viewed in the direction of the arrows.
Figure 10:
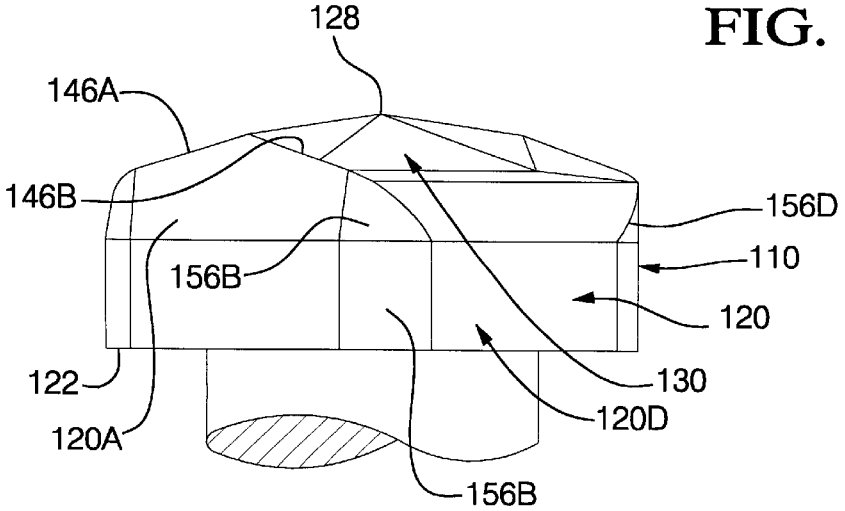
FIG. 10 is a view taken along the line 10—10 in FIG. 8 as viewed in the direction of the arrows.
Figure 11:
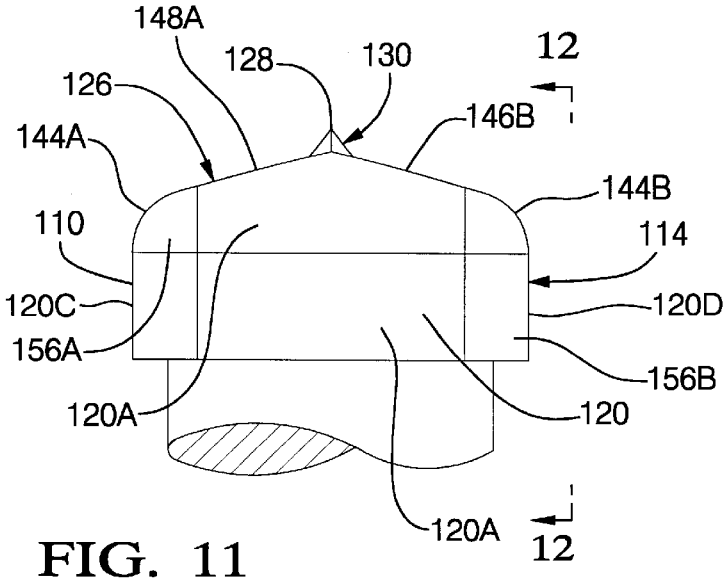
FIG. 11 is a view taken along the line 11—11 in FIG. 8 as viewed in the direction of the arrows.
Figure 12:
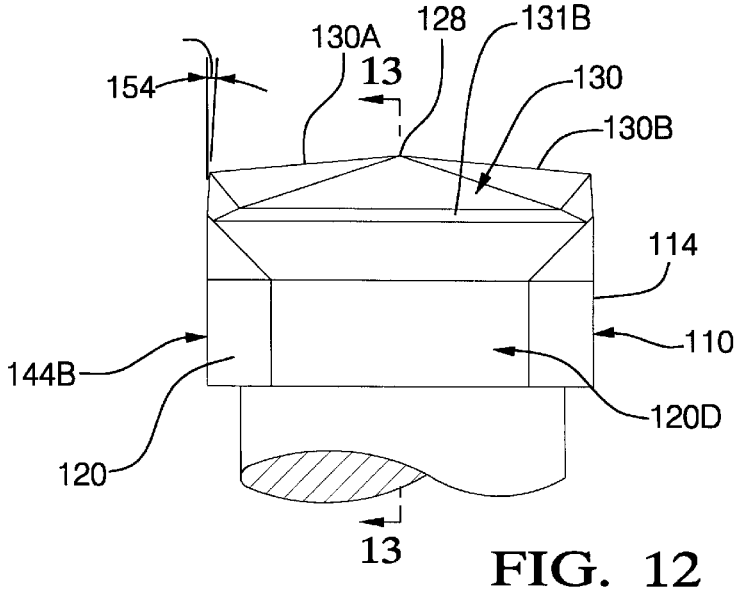
FIG. 12 is a view taken along the line 12—12 in FIG. 11 as viewed in the direction of the arrows.
Figure 13:
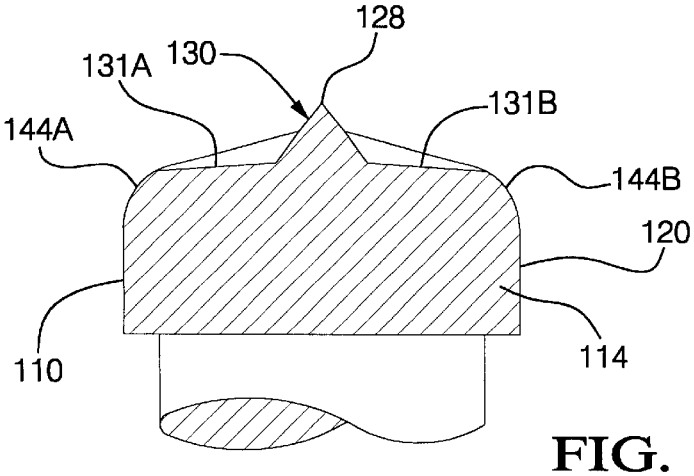
FIG. 13 is a view taken along the line 13—13 in FIG. 12 as viewed in the direction of the arrows.

Following Stage 2, the punch 110 continues to be advanced in what will be referred to as Stage 3 until it reaches its fully extended position shown in FIG. 5. During this stage, the slugs 142A and 142B are fully formed as flat sided sections and folded neatly to the side to form an unobstructed hole 150 with slightly radiused or rounded corners by sliding action of the peripheral side 120 of the punch head against the outer side of the slugs as the punch is advanced. In this operation, the punch 110 is plunged to a predetermined depth in the part slightly less than the distance to an opposite interior side of the part so as to prevent the high point 128 on the punch end face from contacting the latter. The integrity of the internal hydraulic pressure is maintained during Stage 3 by a forced interference fit of the peripheral side 120 of the punch head with the periphery or side of the finished hole wherein the side of the hole 150 as thus formed and shown in FIG. 6 comprises the flat outer sides of the slugs 142A, 142B, two straight and parallel side edges 152A, 152B and four small equally radiused corner edges 154A–D joining the sides of the slugs and the straight edges 152A and 152B. And thus the hole 150 has constant cross sectional dimensions throughout its depth. Following the formation of the hole 150, the punch is retracted from the part to its initial position shown in FIG. 2 and the hydraulic fluid is exhausted from the part to complete the hole forming operation and allow the part to be removed from the die. The hydroformed part 108 with the hole 150 formed therein following removal of the part from the die is shown in FIG. 6.

Describing the details of the punch in further detail for a more in depth understanding of the hole formation operation of the present invention and its versatility, reference is now made to FIGS. 7–13 which show only the punch 110 and in particular its head and end face cutting edge configuration. The punch head is formed symmetrical with respect to planes X-Y and Y-Z which intersect at right angles at the center line 152 (Y—Y) of the punch with the high point 128 of the punch end face 126 located on this center line at the midpoint of the central cutting edge 130 which is centered on the X-Y plane. The central cutting edge 130 projects outwardly of the end face and angles away from the high point 128 at opposite and equal angles along beveled sections 130A and 130B of the edge of decreasing projection from the central high point 128 to where the opposite ends of this cutting edge terminate at peripheral side portions 120A and 120B of the punch head where the peripheral side 120 extends parallel to the Y-Z plane. And it is this centrally located pointed section of the center cutting edge 130 that forms the high point 128 used to create the stress riser in FIGS. 2 and 3, Stage 0 and Stage 1, respectively. The additional side cutting edges 146A,146B and 148A,148B in the cutting edge configuration on the punch end face 126 also project outwardly from the punch end face and are located at the terminal ends of the central cutting edge 130 and angle away at opposite and equal angles from the respective ends of the central cutting edge while similarly diminishing in projection to where they terminate at peripheral side portions 120C and 120D of the punch head which extend parallel to the X-Y plane. And it is these four distinct side cutting edges that cut the side edges of the slugs from the part as described above in Stages 2 and 3 and shown in FIGS. 4 and 5, respectively, and which allow the slugs to bend cleanly into the shape in Stage 3, FIG. 5.

The smoothly contoured portions 144A and 144B of the punch end face 126 are convex cylindrical surfaces having center lines (not shown) parallel to the X-Y plane and blend depressed flat sections between the side cutting edges which form the relieved sections 131A and 131B, respectively, with the peripheral side portions 120C and 120D of the punch head. The peripheral side portions 120A and 120B are formed with a certain draft angle where they meet with the side cutting edges 146A, 146B and 148A, 148B, respectively, at the end face of the punch and include corner radius portions 156A, 156B and 156C, 156D, respectively, which blend the peripheral side portions 120C and 120D, respectively, with peripheral edges of the contoured portions 144A and 144B, at the periphery of the punch face. The peripheral side portions 120A and 120B have a maximum draft angle 154 (see FIG. 12) of for example, 1.4–2.0 degrees along a central major portion thereof with the draft angle gradually decreasing in the corner radius portions to eventually zero at the peripheral side portions 120C and 120D, respectively. This draft angle helps maintain the interference fit (mechanical fluid pressure seal) described above as the punch is advanced into the part to form the hole.

Figure 14:
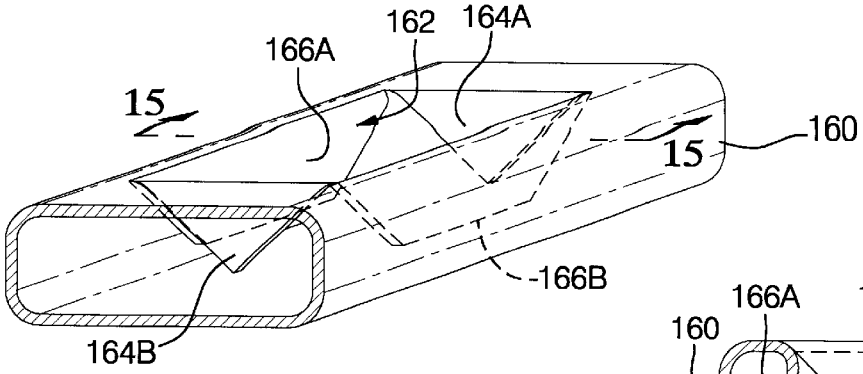
FIG. 14 is a partial three-dimensional view of another hydroformed part having a different configuration with a different shaped hole formed therein in accordance with the present invention.
Figure 15:
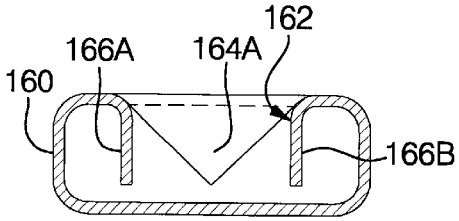
FIG. 15 is a view taken along the line 15—15 in FIG. 14 as viewed in the direction of the arrows.

The method and apparatus of the present invention readily lends itself to the formation of holes of various sizes and shapes in hydroformed parts of various sizes and cross sectional shapes as disclosed by further embodiments of the invention as will now be described and follow from the above teachings which include the principles of punch design and the hole forming Stages 0–3. For example, there is shown in FIGS. 14 and 15 a hydroformed part 160 having an unobstructed hole 162 of rectangular shape with constant cross sectional dimensions that has been formed therein in accordance with the present invention following the teachings above described. In this instance, the hole is again formed by a single punch but having an edge cutting and peripheral side configuration including a central cutting edge bifurcated at both ends and two additional relieved and contoured portions and peripheral side cutting edges whereby such configuration first provides for the fracture of an unsupported wall section of the part without and then with the assist of the hydroforming pressure and then with the assist of this internal hydraulic pressure cuts and bends two pairs of flat slugs164A, 164B and 166A,166B from this section. And wherein the slugs 164A, 164B have a triangular shape and are equal in size and parallel and form the two short sides of the hole, and slugs 166A, 166B have a trapezoidal shape and are equal in size and parallel and form the two long sides of the hole. In a similar matter, it will be understood that a square shaped hole can be similarly formed by fracturing, cutting and bending to form one pair of triangular shape slugs of equal size and one pair of trapezoidal shaped slugs of equal size.

Figure 16:
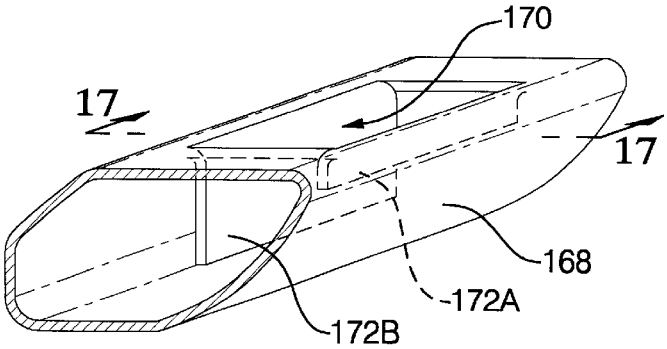
FIG. 16 is a partial three dimensional view of a hydroformed part having a different configuration with a different shaped hole formed therein in accordance with the present invention.
Figure 17:
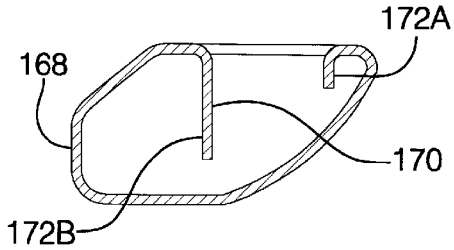
FIG. 17 is a view taken along the line 17—17 in FIG. 16 as viewed in the direction of the arrows.

A further example of the versatility of the present invention is shown in FIGS. 16 and 17 to demonstrate the situation where a hydroformed part 168 has a cross section that varies in dimension from the location on the part in which an unobstructed hole such as one of rectangular shape is desired and as a result the piercing could result in one or more of the pierced slugs hitting the closest interior surface of the part and obstructing the hole. And in the worse possible consequence causing a miss-shaped or distorted hole. In this instance and again following the above teachings of the present invention, an unobstructed hole 170 with constant cross sectional dimensions is formed with a single punch having a central cutting edge and peripheral side configuration whereby such configuration first provides for the fracture of an unsupported wall section of the part without and then with the assist of the hydroforming pressure and then with the assist of this internal hydraulic pressure cuts and bends a single pair of flat slugs 172A, 172B of rectangular shape from this wall section and wherein the slugs form the long sides of the hole and the width of the slugs are unequal and sized so as to prevent their hitting the far interior side of the part. That is, the slug 172A has a relatively small width to prevent it hitting an interior section of the hydroformed part closest to the hole being formed by this slug while the other slug 172B has a larger width as permitted by an interior section of the hydroformed part farthest from the hole portion being formed by this slug.

Figure 18:
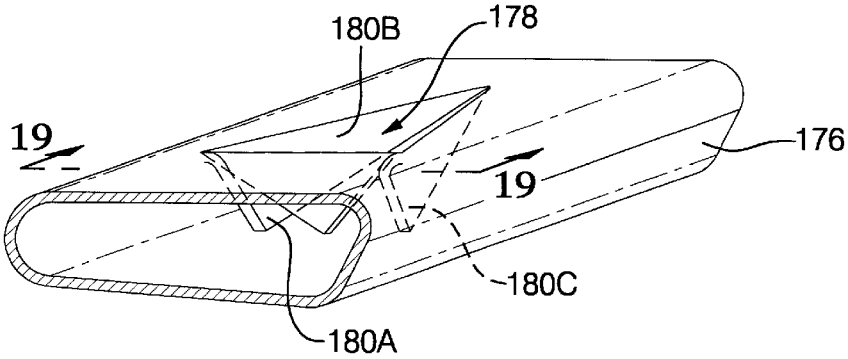
FIG. 18 is a partial three dimensional view of a hydroformed part having a different configuration with a different shaped hole formed therein in accordance with the present invention.
Figure 19:
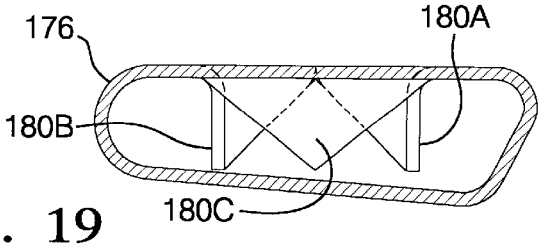
FIG. 19 is a view taken along the line 19—19 in FIG. 18 as viewed in the direction of the arrows.

A further example of the versatility of the present invention is shown in FIGS. 18 and 19 to demonstrate the situation where an unobstructed triangular shaped hole is desired in a shallow hydroformed part 176. In this instance and again following the above teachings of the present invention, an unobstructed hole 178 with constant cross sectional dimensions is formed with a single punch having a cutting edge and peripheral side configuration including a central cutting edge bifurcated at one end and an additional contoured portion and side cutting edge whereby such configuration first provides for the fracture of an unsupported wall section of the part without and then with the assist of the hydroforming pressure and thereafter continuing with the assist of this internal pressure cuts and bends three triangular shaped flat slugs 180A, 180B and 180C from this section. And wherein the slug 180A has a relatively small size and the other two slugs 180B and 180C have a relatively large and equal size but different triangular configuration as shown with such sizes determined to prevent the free tip or apex of the slugs from hitting the interior side of the part. And wherein the free tip or apex of all the slugs is equidistant from where they join with the part where the shallow depth of the part is constant below the hole as shown. Where the shallow depth is not constant, but varies, these triangular slugs can be configured with different dimensions with respect to their free tip so as to not be equidistant from where they join with the part to compensate for the variance in depth and prevent their contacting the interior of the part. Or by way of further example, all three triangular slugs can be of equal size and shape depending on the cross sectional dimensions of the application at the desired hole location.

During formation of a hole with the aid of the hydroforming pressure in Stages 1–3 as above described, it will thus be appreciated that very positive steps have been taken to prevent leaking of the hydraulic fluid during such operations. However, it will be appreciated by those skilled in this art that seals can nevertheless leak especially when subjected to the very high pressures used in hydroforming metal parts. And therefore it will be understood that the sealing provisions provided herein are at least effective to prevent any significant leakage of the hydraulic fluid during the hole forming operations described above.

It will also be understood by those skilled in the art from the above disclosure of preferred and illustrative embodiments of the invention, that the invention may also take other forms based on the above teachings and that therefore the invention is intended to be limited only by the scope of the appended claims.

What is claimed is:

1. A method of forming an unobstructed hole in a hollow hydroformed metal part comprising the steps of (a) closing a hydroforming die about a hollow metal part, (b) initiating a stress riser in an unsupported wall section of the part with a punch during closure of the die, (c) establishing hydraulic fluid under pressure in the part forcing the part to conform to a die cavity surface in the die while substantially increasing the magnitude of the stress riser with the punch and the hydraulic pressure, (d) bending and stretching the unsupported wall section with further aid of the punch and hydraulic pressure to fracture the unsupported wall section at the stress riser without significantly leaking the hydraulic fluid, (e) cutting the unsupported wall section starting at the fracture with further aid of the punch and hydraulic pressure without significantly leaking the hydraulic fluid to form at least two slugs remaining integral with the part wherein the slugs are sized to prevent their contact with the part when bent inward of the part, and (f) bending the slugs inward of the part with further aid of the punch and hydraulic pressure without significantly leaking the hydraulic fluid to form an unobstructed hole in the part.

2. A method of forming an unobstructed hole in a hollow hydroformed metal part comprising the steps of (a) closing a hydroforming die about a hollow metal part, (b) initiating a stress riser in an unsupported wall section of the part with a high point of a cutting edge configuration on an end face of a punch during closure of the die, (c) establishing hydraulic fluid under pressure in the part forcing the part to conform to a die cavity surface in the die while substantially increasing the magnitude of the stress riser without movement of the punch by forcing the unsupported wall section to bend and stretch about the high point with the hydraulic pressure, (d) further bending and stretching the unsupported section of the part about the high point with movement of the punch and further aid of the hydraulic pressure to fracture the unsupported wall section at the stress riser without significantly leaking the hydraulic fluid, (e) cutting and bending the unsupported wall section inward of the part starting at the fracture with the cutting edge configuration and contoured portions on the end face of the punch with further movement of the punch and aid of the hydraulic pressure to form a plurality of slugs remaining integral with the part without significantly leaking the hydraulic fluid wherein the slugs are sized to prevent their contact with the part when bent inward of the part, and (f) further bending the slugs inward of the part with a peripheral side of the punch with further movement of the punch and aid of the hydraulic pressure to form an unobstructed hole in the part without significantly leaking the hydraulic fluid.

3. A method of forming an unobstructed hole in a hollow hydroformed metal part comprising the steps of (a) closing a hydroforming die about a hollow metal part, (b) initiating a stress riser in an unsupported wall section of the part with a high point of a cutting edge configuration on an end face of a punch during closure of the die, (c) establishing hydraulic fluid under pressure in the part forcing the part to conform to a die cavity surface in the die while substantially increasing the magnitude of the stress riser without movement of the punch by forcing the unsupported wall section to bend and stretch about the high point with the hydraulic pressure, (d) further bending and stretching the unsupported wall section of the part about the high point with movement of the punch and further aid of the hydraulic pressure to fracture the unsupported wall section at the stress riser without significantly leaking the hydraulic fluid, (e) cutting the unsupported wall section starting at the fracture with the cutting edge configuration on the punch and further movement of the punch and aid of the hydraulic pressure to form a plurality of slugs remaining integral with the part without significantly leaking the hydraulic fluid wherein the slugs are sized to prevent their contact with the part when bent inward of the part, and (f) bending the slugs inward of the part as they are cut with contoured portions on the end face of the punch and then by an interference fit of a peripheral side of the punch with the slugs on further movement of the punch and aid of the hydraulic pressure to form an unobstructed hole in the part without significantly leaking the hydraulic fluid.

4. A method as defined in claim 3 wherein the slugs are formed with flat sides by the peripheral side of the punch.

5. A method as defined in claim 3 wherein at least two slugs are formed with different sizes.

6. A method as defined in claim 3 wherein at least two slugs are formed with different shapes.

7. A method as defined in claim 3 wherein at least two slugs are formed with different sizes and shapes.

8. A method as defined in claim 3 wherein the high point on the punch end face projects past the die cavity surface a predetermined distance so as to contact and bend the unsupported wall section to initiate the stress riser when the die is closed and wherein the slugs are formed with flat sides by the peripheral side of the punch.

* * * * *